US011889897B2

(12) United States Patent
Moretti Polegato et al.

(10) Patent No.: US 11,889,897 B2
(45) Date of Patent: Feb. 6, 2024

(54) FOOTWEAR ITEM WITH REMOVABLE LINING

(71) Applicant: GEOX S.p.A., Montebelluna (IT)

(72) Inventors: Mario Moretti Polegato, Montebelluna (IT); Livio Poloni, Montebelluna (IT)

(73) Assignee: GEOX S.p.A., Montebelluna (IT)

( * ) Notice: Subject to any disclaimer, the term of this patent is extended or adjusted under 35 U.S.C. 154(b) by 358 days.

(21) Appl. No.: 17/289,071

(22) PCT Filed: Nov. 12, 2019

(86) PCT No.: PCT/IB2019/059699

§ 371 (c)(1),
(2) Date: Apr. 27, 2021

(87) PCT Pub. No.: WO2020/100025

PCT Pub. Date: May 22, 2020

(65) Prior Publication Data

US 2022/0007790 A1 Jan. 13, 2022

(30) Foreign Application Priority Data

Nov. 14, 2018 (IT) ..... 102018000010320

(51) Int. Cl.
*A43B 23/07* (2006.01)
*A43B 3/24* (2006.01)
*A43B 23/02* (2006.01)

(52) U.S. Cl.
CPC ..... *A43B 23/07* (2013.01); *A43B 3/242* (2013.01); *A43B 23/0205* (2013.01); *A43B 23/0245* (2013.01)

(58) Field of Classification Search
CPC ..... A43B 23/07; A43B 3/242; A43B 3/24
USPC ..... 36/10, 55, 100
See application file for complete search history.

(56) References Cited

U.S. PATENT DOCUMENTS 4,169,324 A * 10/1979 Gibbs ..... A41B 11/12 2/919
10,609,981 B1 * 4/2020 Phinney ..... A43B 7/149
2004/0159017 A1 8/2004 Martin
2004/0200098 A1 10/2004 Martin et al.
2006/0117606 A1 6/2006 Chen et al.
(Continued)

FOREIGN PATENT DOCUMENTS

DE 39 24 240 A1 6/1990
KR 10-1325816 B1 11/2013

OTHER PUBLICATIONS

International Search Report dated Mar. 16, 2020 in PCT/IB2019/059699 filed on Nov. 12, 2019.

*Primary Examiner* — Marie D Bays
(74) *Attorney, Agent, or Firm* — Oblon, McClelland, Maier & Neustadt, L.L.P.

(57) ABSTRACT

A footwear structure includes an upper provided with a mouth, a tip end and a front portion that is between the mouth and the tip end, a first lining housed inside the footwear structure, and a first through opening arranged on the front portion of the upper, and a first appendage externally arranged on the first lining at a position substantially corresponding to the first through opening, wherein the first appendage engages the first through opening and wherein the first appendage is accessible from the outside of the footwear structure.

16 Claims, 5 Drawing Sheets

(56) References Cited

U.S. PATENT DOCUMENTS

| | | | | |
|---|---|---|---|---|
| 2009/0100713 | A1* | 4/2009 | Adami | A43B 5/02 36/133 |
| 2010/0236100 | A1* | 9/2010 | Ho | A43B 3/24 36/100 |
| 2012/0011744 | A1* | 1/2012 | Bell | A43B 23/0245 36/91 |
| 2012/0204359 | A1 | 8/2012 | Adami et al. | |
| 2017/0181501 | A1* | 6/2017 | Gautier | A43C 1/00 |
| 2019/0166953 | A1* | 6/2019 | Lo | A43B 3/0078 |
| 2020/0068991 | A1* | 3/2020 | Steere, Jr. | A43B 3/24 |

* cited by examiner

FOOTWEAR ITEM WITH REMOVABLE LINING

FIELD OF THE INVENTION

In its most general aspect, the present invention refers to the technical field of footwear and in particular the invention concerns a footwear item comprising a removable lining.

STATE OF THE ART

Today, shoes provided with removable inner components are known, in particular footwear provided with removable linings.

Removable linings may have, for example, characteristics of softness, thermal insulation, breathability, waterproofness, washability, and be provided with a bottom substantially corresponding to the surface in contact with the sole of a user's foot, more rigid with respect to the rest of the removable lining and suitable to support direct contact with the ground.

In practice, certain removable linings may themselves be used as footwear and are therefore also referred to as inner shoes, removable shoes or simply shoes.

Generally speaking, footwear of the above said type comprises an upper and a sole combined with each other to form a footwear structure, and a removable lining provided with combining means for the temporary fixing to the upper.

Patent application WO 01/33987 describes, for example, footwear comprising an upper combined with a sole to form a footwear structure into which a shoe can be removably inserted, wherein the shoe can be removably fixed to the upper by means of press studs or by means of tear-off fastening strips of the so-called "hook and loop" type, for example the type commercially known as Velcro®. The shoe, in a plantar region, is provided with an insole suitable for walking.

U.S. Pat. No. 2,422,410 describes a removable lining for shoes and slippers provided with connecting means for the removable attachment to the upper of the shoe or slipper, wherein in an embodiment the removable lining is provided with openings to pass a lace therethrough.

Patent application WO 2006/060057 describes footwear comprising an upper having a collar and an outsole combined with the upper, so as to form a footwear structure, which is provided with interchangeable linings that can be removably fixed to the collar, for example through tear-off fastening strips of the so-called "hook and loop" type, press studs, zippers, and wherein each lining is provided with a ribbon to be grasped and pulled to allow the lining to be extracted from the footwear structure.

Although advantageous, the above described solutions provided in the known art are not free from drawbacks, including the difficulty of laying out the removable lining inside the footwear structure in order to make it as much as possible adherent to the upper, in order to reduce or eliminate unwanted creases and wrinkles that could make the shoe uncomfortable for the user.

In this regard, in order to prevent the formation of creases and wrinkles, it is common to insert a hand or more generally an appropriately sized body into the removable lining so as to lay it out better in the footwear structure before inserting the foot in the same footwear.

This way, however, the formation of creases and wrinkles is not completely prevented, particularly in those regions inside the footwear structure that are more difficult to reach, for example near the toe, where the inside of the footwear structure becomes tight and more difficult to reach than, for example, the heel region.

It should also be noted that creases and wrinkles may also be due to the fact that in certain regions of the footwear structure, such as the region corresponding to the dorsal portion of the foot, the removable lining can only be pushed against the upper, and not pulled such as at the heel region.

It is known, as well, the solution described in U.S. Pat. No. 7,434,336, which discloses a footwear item comprising a footwear structure and a removable self-locking sock, wherein the footwear structure comprises an upper equipped with a tongue and a sole combined with the upper, in which tear-off fastening strips of the so-called "hook and loop" type are arranged in corresponding positions on the inner surface of the footwear structure and on the outer surface of the sock, particularly tear-off fastening strips arranged at the plantar region and tear-off fastening strips arranged at the foot instep-tongue.

Disadvantageously, however, in order to fix the sock in the proper position, the tongue of the footwear structure has to be lifted so as to prevent the sock and the footwear structure, in the region of the instep of the sock itself and of the tongue of the footwear structure, respectively, from accidentally early contacting each other at the respective tear-off fastening strips, otherwise it would be considerably difficult, or even impossible, to insert the self-locking sock completely into the footwear structure.

In this regard, it should be said that disadvantageously the lifting of the tongue is difficult in footwear structures equipped with laces, tear-off fastening strips or in general with tightening means constrained to the upper and placed above the tongue.

In fact, to lift the tongue, the tightening means have to be totally or at least partially released from the upper, an operation that, among other things, also prolongs the time needed to wear the footwear structure and therefore the footwear item described in U.S. Pat. No. 7,434,336.

SUMMARY OF THE INVENTION

The technical problem underlying the present invention was to provide a footwear item comprising a footwear structure and a lining removably housed inside the aforesaid footwear structure, having structural and functional characteristics able to overcome one or more of the drawbacks mentioned above with reference to the known art.

According to the invention the above problem is solved by a footwear item comprising:

- a footwear structure having an upper provided with a mouth, a tip end and a front portion between the aforesaid mouth and the aforesaid tip end,
- a first lining housed inside the aforesaid footwear structure, and
- first combining means to removably combine the aforesaid first lining with the aforesaid upper, characterized in that

- the aforesaid first combining means comprise at least one first through opening arranged on the aforesaid front portion of the aforesaid upper, and at least one first appendage externally arranged on the aforesaid first lining at a position substantially corresponding to the aforesaid at least one first through opening, wherein the aforesaid at least one first appendage engages the aforesaid at least one first through opening, the aforesaid at least one first appendage being accessible from the outside of the aforesaid footwear structure.

Preferably, the aforesaid front portion of the aforesaid upper comprises a vamp and a tongue.

Preferably, the aforesaid at least one first through opening is arranged on the aforesaid tongue.

Preferably, the aforesaid at least one first through opening is arranged on the aforesaid tongue at a position proximal to the aforesaid vamp.

Preferably, the aforesaid at least one first appendage comprises a ring-shaped body.

Preferably, the aforesaid first combining means comprise closing-opening elements to close-open the aforesaid ring-shaped body of the aforesaid first appendage.

Preferably, the aforesaid at least one first appendage is made of a flexible material.

Preferably, the aforesaid at least one first appendage consists of a fabric ribbon.

Preferably, the aforesaid footwear item comprises second combining means to removably combine the aforesaid first lining with the aforesaid upper.

Preferably, the aforesaid second combining means comprise at least one second appendage externally arranged on the aforesaid first lining and having a first combining element, and a second combining element cooperating with the aforesaid first combining element and externally arranged on the aforesaid upper.

Preferably, the aforesaid second combining means are arranged at the hindfoot of the aforesaid footwear item.

Preferably, the aforesaid first lining comprises an upper portion intended to wrap around the dorsal and side surfaces of a user's foot, and a lower portion combined with the aforesaid upper portion and intended to be in contact with the plantar surface of the user's foot.

Preferably, the aforesaid upper portion comprises a first portion proximal to the aforesaid lower portion and a second portion distal from the aforesaid lower portion, wherein the aforesaid second portion has a décolletage oriented towards the aforesaid tip end of the aforesaid upper.

Preferably, the aforesaid upper portion is at least partially made of a first material and the aforesaid lower portion is at least partially made of a second material, wherein the aforesaid first material and the aforesaid second material are different from each other.

Preferably, the aforesaid first material is selected from the group comprising: hides; breathable material including breathable fabric; so-called three-dimensional fabric; fabric or hides having a polymeric material deposited thereon; insulating material including padding or natural or synthetic films.

Preferably, the aforesaid second material is selected from the group comprising: polymeric material including vulcanized rubber, thermoplastic rubber (TR), thermoplastic polyurethane (TPU), ethylene-vinyl acetate (EVA); three-dimensional fabric; fabric or hides coated with resin or polymeric material; fabric or hides having a thermoplastic polymeric material deposited thereon; nonwoven fabric including felt; leather; breathable material including breathable fabric.

Preferably, the aforesaid upper includes an eyestay.

Preferably, the aforesaid footwear item comprises closing-opening means to close-open the aforesaid footwear structure and/or the aforesaid first lining.

Preferably, the aforesaid closing-opening means to close-open the aforesaid footwear structure and/or the aforesaid first lining are selected from the group comprising: laces cooperating with holes, bodkins, bitts or hooks; straps cooperating with buckles; tear-off fastening strips of the so-called "hook and loop" type; elastic bands. In case the aforesaid closing-opening means to close-open the aforesaid footwear structure comprise one or more straps, one or more tear-off fastening strips of the so-called "hook and loop" type, and/or one or more elastic bands, the aforesaid at least one through opening may also be made at the aforesaid one or more straps, one or more tear-off fastening strips of the so-called "hook and loop" type, and/or one or more elastic bands, the aforesaid at least one through opening, according to the present invention, being an opening connecting the inside of the aforesaid footwear structure with the outside of the aforesaid footwear structure and which, when the aforesaid footwear item or at least the aforesaid footwear structure is in use, is arranged on the aforesaid front portion of the upper of the aforesaid footwear structure between the aforesaid mouth and the aforesaid tip end.

Preferably, the aforesaid closing-opening means to close-open the aforesaid footwear structure and/or the aforesaid first lining comprise at least one lace, one first plurality of through holes arranged on the aforesaid upper and engaged by the aforesaid at least one lace, and one second plurality of through holes arranged on the aforesaid first lining and engaged by the aforesaid at least one lace.

Preferably, the through holes of the aforesaid first plurality of through holes, and the through holes of the aforesaid second plurality of through holes are arranged in positions corresponding to each other on the aforesaid footwear structure and on the aforesaid first lining, respectively.

Preferably, the aforesaid at least one lace engages a loop defined by the aforesaid ring-shaped body of the aforesaid first appendage.

Preferably, the aforesaid tongue is provided with a pair of notches arranged on opposite edges, a notch for each edge, thereby defining an upper portion of tongue and a lower portion of tongue which are placed respectively above and below the aforesaid notches.

Preferably at the aforesaid upper portion of tongue, the aforesaid first lining is interposed between the aforesaid tongue and the aforesaid eyestay, and at the aforesaid lower portion of tongue, the aforesaid tongue is interposed between the aforesaid first lining and the aforesaid eyestay.

Preferably, the depth of the aforesaid notches is between 5 mm and 35 mm, more preferably between 10 mm and 30 mm.

Preferably, the aforesaid footwear structure comprises a sole constrained to the aforesaid upper, and a second lining combined with the aforesaid upper and the aforesaid sole possibly with the interposition of a midsole.

Preferably, the aforesaid second lining is a fixed lining comprising a first layer or bottom layer combined, from the inside, with a plantar portion of the aforesaid footwear structure, for example the aforesaid sole or midsole, and a second layer or covering layer combined with the aforesaid upper inside the aforesaid footwear structure, wherein more preferably the aforesaid first layer comprises a three-dimensional fabric and wherein still more preferably the aforesaid second layer comprises a three-dimensional channelled fabric.

Preferably, the aforementioned footwear item comprises an insole that can be removably combined with the inside of the aforementioned footwear structure.

Preferably, the aforesaid insole has a volume substantially corresponding to the volume of the aforesaid first lining.

BRIEF DESCRIPTION OF THE FIGURES

Further characteristics and advantages of the invention will be better highlighted by considering the following detailed description of some preferred, but not exclusive, embodiments illustrated by way of example only and without limitations, with the aid of the accompanying drawings, in which.

DETAILED DESCRIPTION OF THE INVENTION

Figure 1:
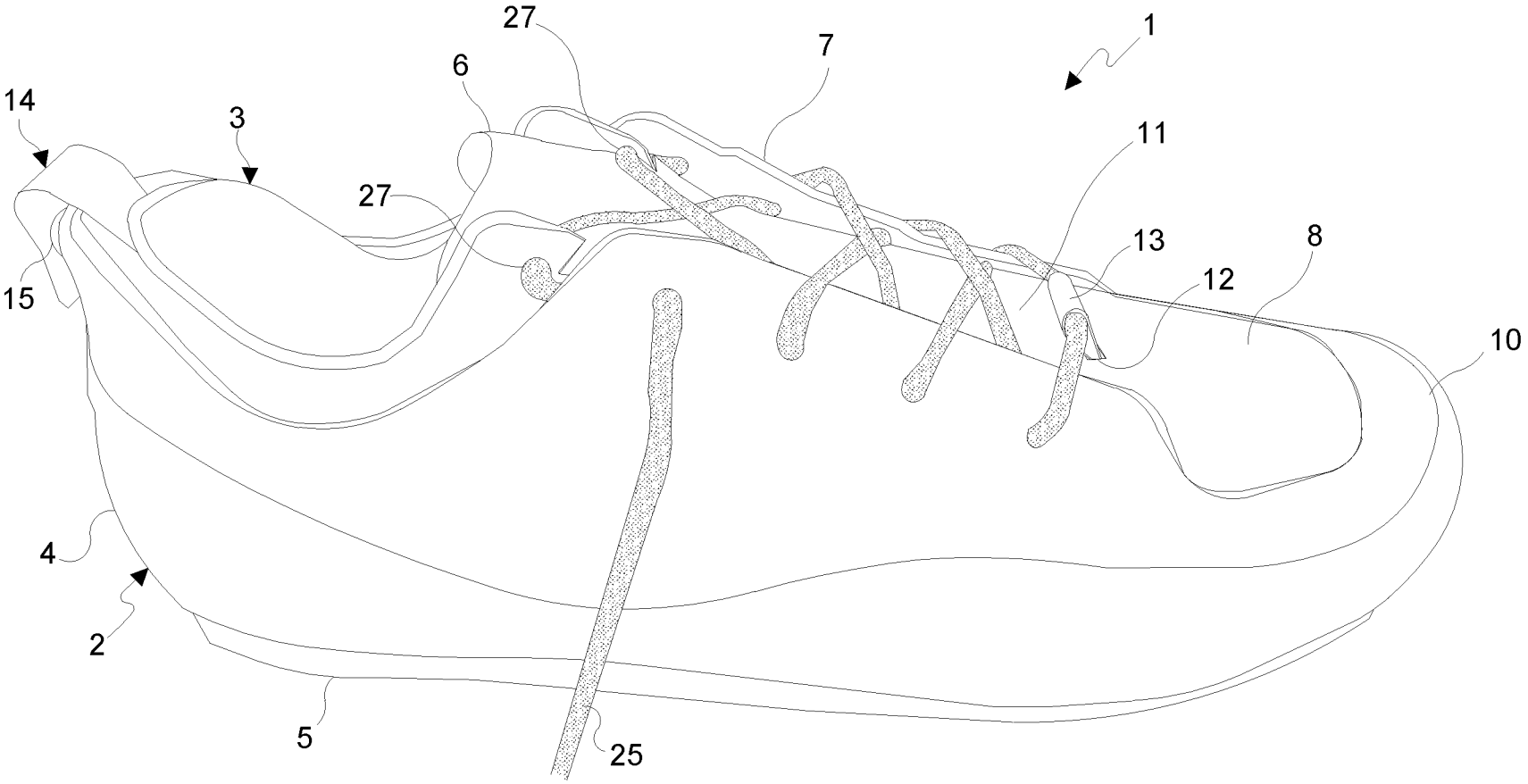
FIG. 1 shows a perspective view of a footwear item comprising a footwear structure and a first lining removably housed inside the aforesaid footwear structure, according to the present invention.
Figure 2:
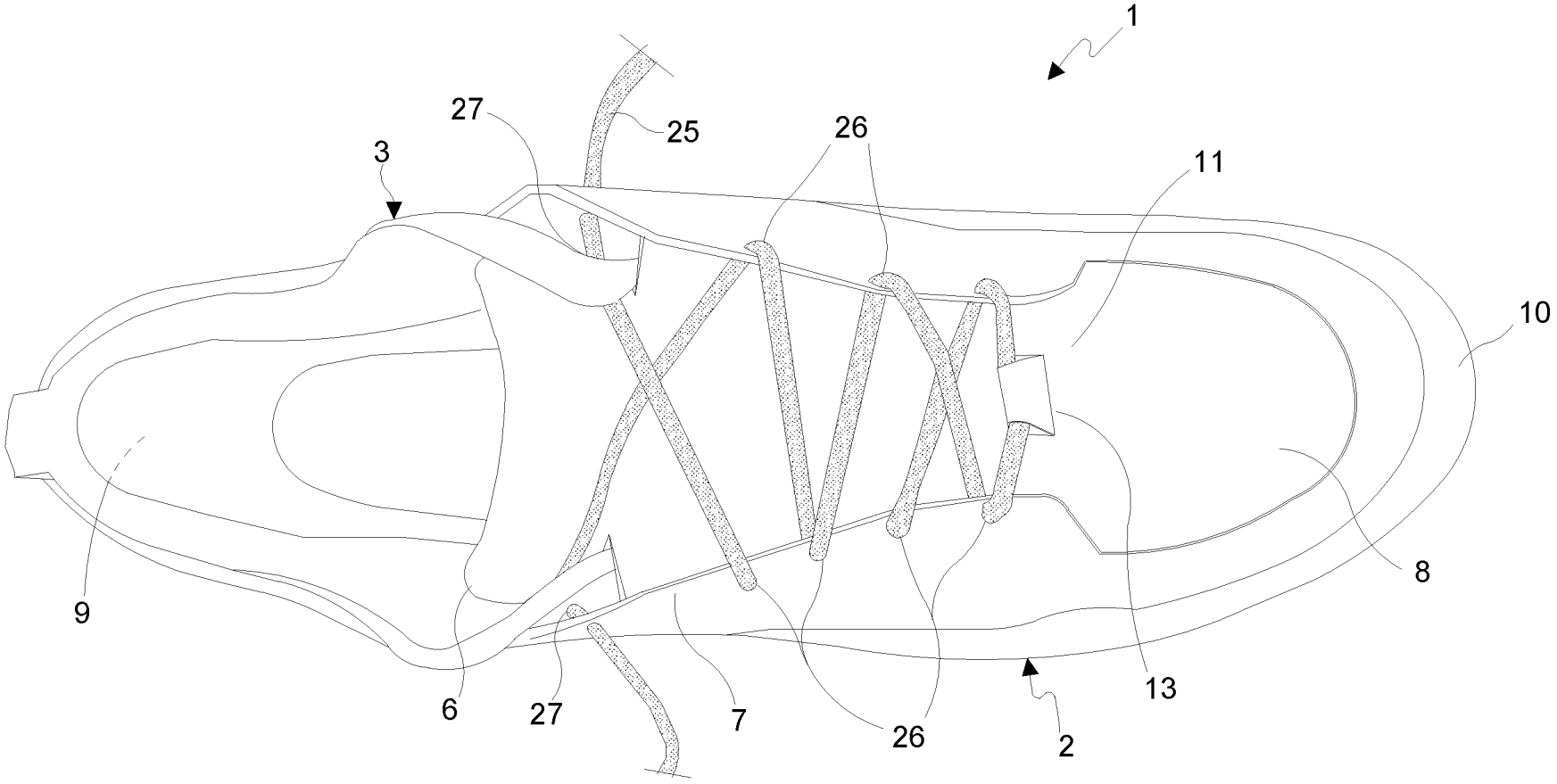
FIG. 2 shows a top view of the footwear item of FIG. 1.
Figure 3:
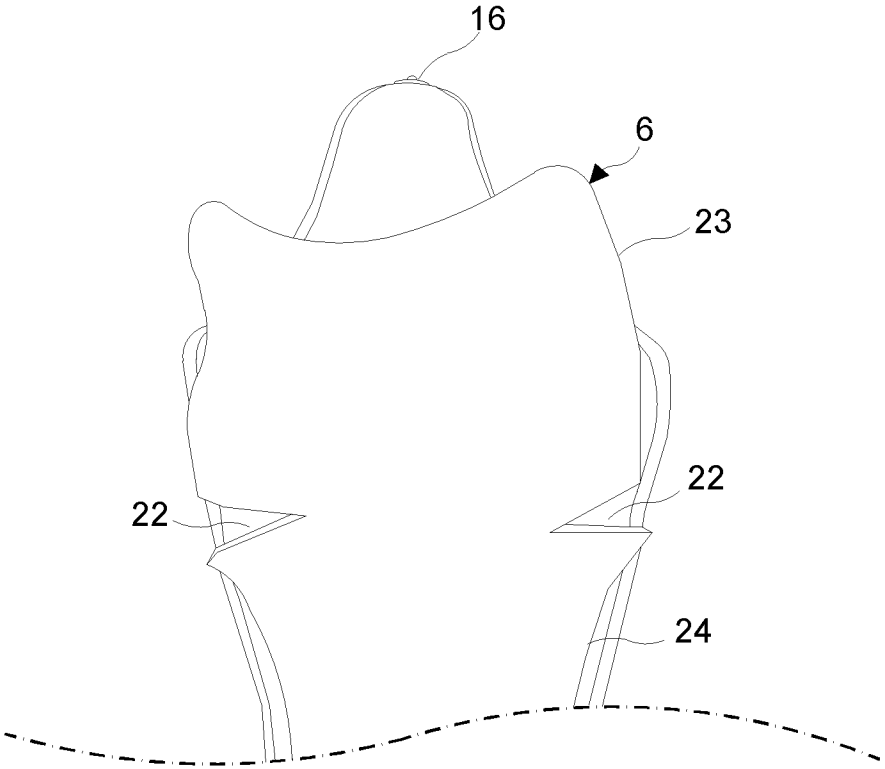
FIG. 3 shows a perspective front view of a detail of the footwear structure of the footwear item of FIG. 1.
Figure 4:
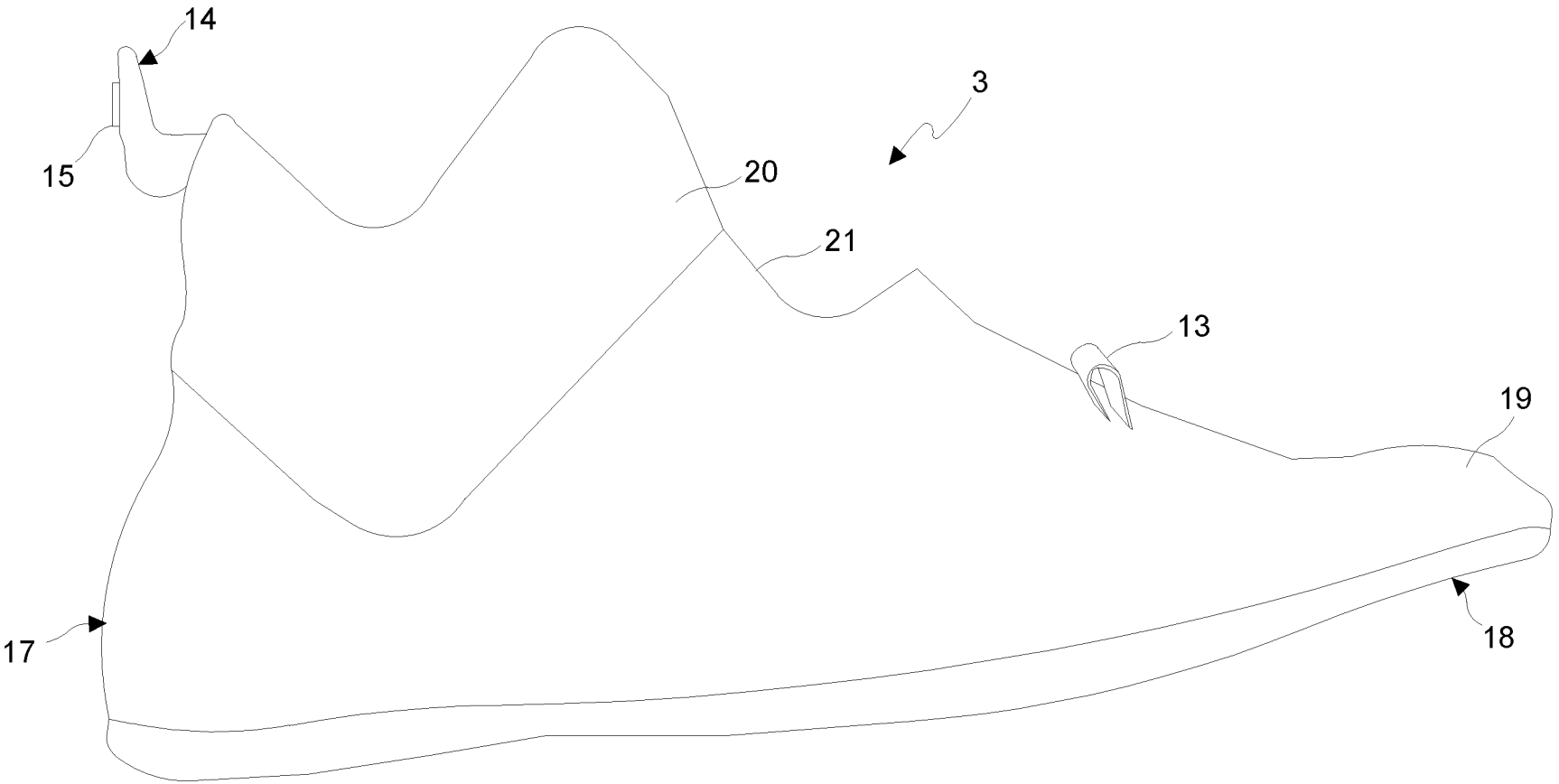
FIG. 4 shows a side view of the first lining of the footwear structure of FIG. 1.
Figure 5:
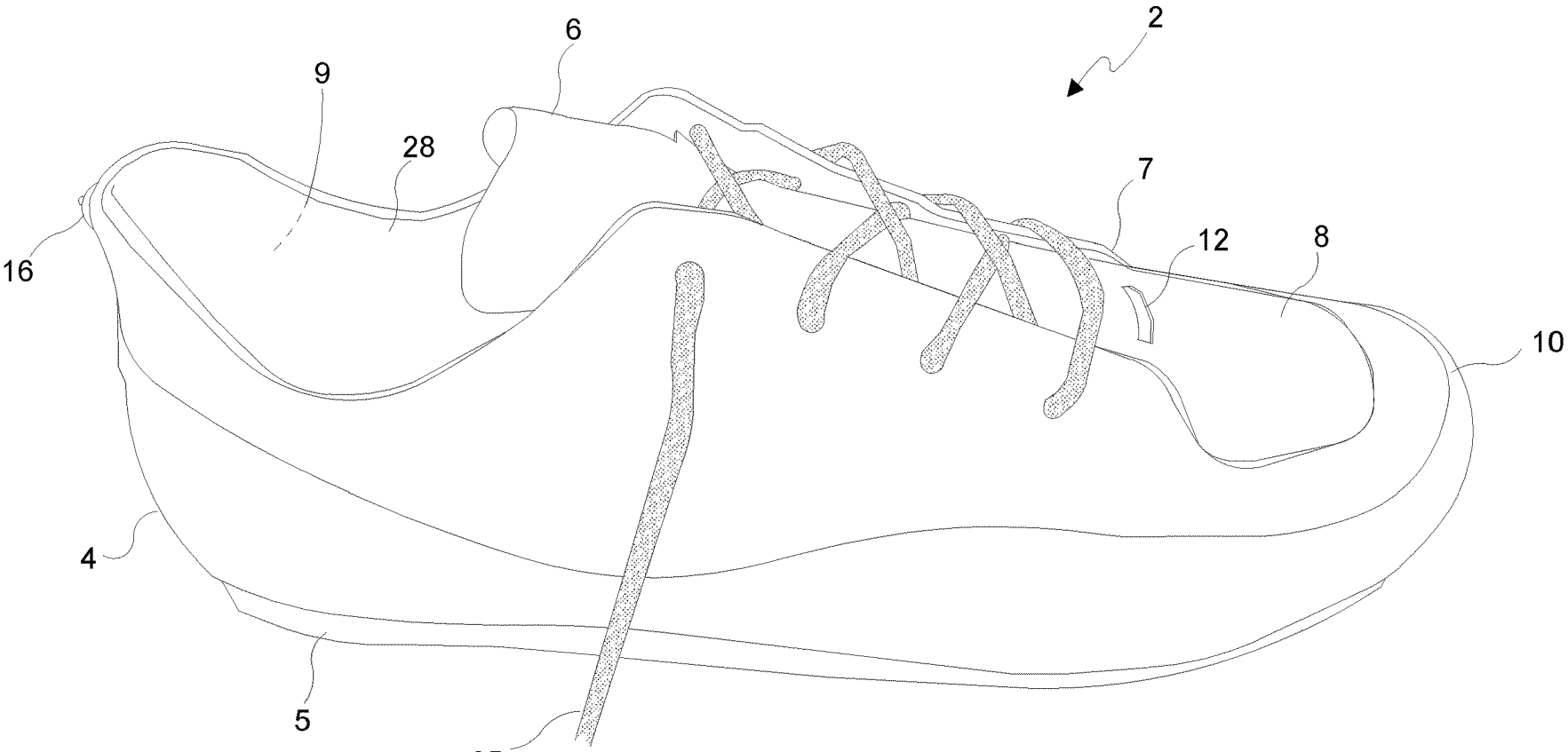
FIG. 5 shows a perspective view of the footwear structure of the footwear item of FIG. 1.

With reference to the aforesaid figures, the numeral 1 generally denotes a footwear item according to the present invention.

The footwear item 1 essentially comprises a footwear structure 2 and a first lining 3 removably housed inside the footwear structure 2.

The footwear structure 2 comprises an upper 4 and a sole 5 combined with the upper 4, and in practice it is a footwear that can be used independently of the first lining 3 which, preferably and as will be better evident hereinafter, if necessary can also be used as footwear independently of the footwear structure 2, as it is basically a shoe removable from the footwear structure 2.

According to the examples of the figures, the upper 4 comprises a tongue 6, an eyestay 7 and a vamp 8, although, according to the present invention, an upper without tongue and eyestay can also be provided, depending on the model of footwear and therefore on the footwear structure.

Therefore, according to the above and according to the present invention, generalizing it can be said that the upper 4, which is provided with a mouth 9 for a user's foot, comprises a tip end 10 and a front portion 11 between the mouth 9 and the tip end 10.

Therefore, the front portion 11 of the upper 4 comprises the tongue 6 and the vamp 8, and more generally it comprises a dorsal portion, a tip portion and a side portion of the upper 4.

In order to removably combine the first lining 3 with the footwear structure 2, the footwear item 1 comprises first combining means which, according to the invention, comprise at least one first through-opening arranged on the front portion 11 of the upper 4, and at least one first appendage externally arranged on the first lining 3 at a position substantially corresponding to the at least one first through-opening arranged on the upper 4.

In particular, according to the examples of the figures, the aforesaid first combining means comprise a first through opening 12 arranged on the tongue 6 at a position proximal to the vamp 8, and a first appendage 13 externally arranged on the first lining 3 at a position substantially corresponding to the first through opening 12, although it is possible, as mentioned above, to provide the first through opening at a different position on the front portion of the upper, then also the first appendage at a different and corresponding position on the first lining, and it is possible as well to provide more first through openings made on the upper and more first appendages arranged in corresponding positions on the first lining.

In practice, according to the invention, the first appendage 13 engages the first through opening 12 and is advantageously accessible from the outside of the footwear structure 2, so as to allow the first lining 3 to be pulled and laid out inside the footwear structure 2 at the front portion 11 of the upper 4, as will be better evident hereinafter.

According to the invention, the first appendage 13 comprises a ring-shaped body and in particular is made of a flexible material, advantageously a fabric ribbon.

According to the examples of the figures, the aforesaid ring-shaped body made of fabric is shown to be closed, for example by a sewing of the ribbon, although it is possible to provide first combining means comprising closing-opening elements to close-open the ring-shaped body, such as for example press studs.

Still according to the invention it should be said that the footwear item 1 comprises second combining means to removably combine the first lining 3 and the upper 4 with each other.

In detail, the second combining means comprise a second appendage 14 externally arranged on the first lining 3 and provided with a first combining element 15, and a second combining element 16 cooperating with the first combining element 15 externally arranged on the upper 4.

Also the second appendage 14, like the first appendage 13, preferably consists of a fabric ribbon, whereas the first combining element 15 and the second combining element 16 are advantageously embodied by a female component and a male component, respectively, of a press stud.

It should be added that, according to the examples of the figures, the aforesaid second combining means are arranged at the hindfoot of the footwear item 1, therefore at the hindfoot of the footwear structure 2 and at the hindfoot of the first lining 3 and that they advantageously allow the relative movement between the first lining 3 and the footwear structure 2 to be limited.

It should also be added that, according to the present invention, in addition to or as an alternative to the above, the second combining means may comprise tear-off fastening strips, for example of the so-called "hook e loop" type, i.e. at least one pair of complementary strips, one in place of the aforesaid female component and the other in place of the aforesaid male component, and/or press studs or magnets, for example at the heel of the footwear item.

It should be said that, as regards the first lining 3, it comprises an upper portion 17 intended to wrap around the dorsal and side surfaces of the user's foot, and a lower portion 18 combined with the upper portion 17 and intended to be in contact with the plantar surface of the user's foot.

According to the invention, to give the desired properties to the first lining 3, the upper portion 17, or a part of it, can be made of a first material, and the lower portion 18, or a part of it, can be made of the same first material or of a second different material.

For example the first material can be selected from the group comprising: hides, breathable material including breathable fabric, so-called three-dimensional fabric; fabric or hides having a polymeric material deposited thereon, insulating material including padding or natural or synthetic films, whereas the second material can be selected from the group comprising: polymeric material including vulcanized rubber, thermoplastic rubber (TR), thermoplastic polyurethane (TPU), ethylene-vinyl acetate (EVA); three-dimensional fabric; fabric or hides coated with resin or polymeric material; fabric or hides having a thermoplastic polymeric material deposited thereon; nonwoven fabric including felt; leather; breathable material including breathable fabric.

As known, breathable material or fabric means a material or fabric that is permeable to water vapor.

A so-called three-dimensional fabric is a fabric of known type whose constituent fibers are arranged in a planar, mutually perpendicular, relation.

As known, a fabric or hides having a polymeric material deposited thereon means a fabric or hides on which a polymeric material such as thermoplastic polyurethane (TPU) is deposited, for example by co-molding, casting, thermoforming, welding, flocking.

Therefore, according to the above, it is possible to make the upper portion 17 and/or the lower portion 18 of the first lining 3, which comprise for example one or more structural portions including polymeric material alternated with one or more functional portions, for example without polymeric material, including breathable material.

In this regard it should be said that, thanks to the possibility of multiple embodiments of the first lining, the most diverse needs can be advantageously met by allowing the creation, for example, of a first lining provided with high thermal insulation for colder climates, or a first lining particularly breathable for warmer climates, or a first waterproof and breathable lining to obtain a footwear item particularly suitable for rainy climates, wherein in the present footwear item the various first linings can be replaced with each other without changing the footwear structure, that is to say even having only one footwear structure.

This is advantageous because there is no need to carry an additional footwear item, for example a second pair of shoes with different characteristics, since it is sufficient to have an additional first lining or more first linings with, anyway, a significantly reduced bulkiness.

In addition, when a first lining is worn or no longer suitable for use, it can be easily replaced.

Moreover, the possibility of removing the first lining from the footwear structure makes it possible to dry more quickly the first lining as well as the upper of the footwear structure and, if the materials of which it is made allow it, also to wash it separately from the footwear structure.

Advantageously, a first removable lining of the aforesaid type can also be used as a home slipper, to be then quickly inserted into the footwear structure when there is a need to go out, or vice versa. This is particularly advantageous, for example, in case of children who frequently go in and out of a house.

Again with regard to the first lining 3, it should be said that, according to the examples of the figures and according to the present invention, the upper portion 17 comprises a first portion 19 proximal to the lower portion 18 and a second portion 20 distal from the lower portion 18, wherein the second portion 20 has a décolletage (décolleté) 21 facing the tip end 10 of the upper 4.

Advantageously, a first lining with a décolletage as depicted above, further helps the contact and adherence between the same first lining 3 and the upper 4, especially in the region corresponding to the instep, where creases and wrinkles of the first lining can be formed more easily.

In this regard, it should be said that according to the examples of the figures and according to the present invention, the tongue 6 is provided with a pair of notches arranged on opposite edges, a notch 22 for each edge, which partition off the tongue 6 into a upper portion of tongue 23 and a lower portion of tongue 24.

According to the present invention, therefore, according to the embodiment shown in the examples of the figures, the first lining 3 "crosses" the tongue 6 so that at the upper portion of tongue 23, the first lining 3 is interposed between the tongue 6 and the eyestay 7, and at the lower portion of tongue 24, the tongue 6 is interposed between the first lining 3 and the eyestay 7.

A first lining that "crosses" the tongue of the upper is advantageous not only to facilitate the contact and adherence between the first lining 3 and the upper 4 in the region corresponding to the instep and especially at the eyestay 7, as mentioned above, but also because it limits the relative movement of the first lining 3 with respect to the upper 4, which can cause wear by friction.

In addition, the possibility that dust, dirt, water or foreign bodies in general may find a space in which to creep in is limited.

It should be added that the depth of the notches 22 is preferably between 5 mm and 35 mm, and more preferably between 10 mm and 30 mm, depending on the size and model of the footwear article according to the present invention.

It should be added that, according to the invention, the present footwear item preferably comprises closing-opening means to close-open the aforesaid footwear structure and/or the aforesaid first lining.

In practice, according to the invention, it is possible to provide either closing-opening means to close-open only the footwear structure or only the first lining, or closing-opening means operating both on the footwear structure and on the first lining, or else first closing-opening means to close-open the footwear structure and second closing-opening means to close-open the first lining can be provided.

The closing-opening means to close-open the present footwear item can be selected from the group comprising: laces cooperating with holes, bodkins, bitts, hooks; straps cooperating with buckles; tear-off fastening strips of the so-called "hook and loop" type; elastic bands.

In detail, according to the examples of the figures, the footwear item 1 comprises a lace 25 of known type combined with both the footwear structure 2 and the first lining 3, although, as mentioned above, it is possible to provide a lace combined only with the footwear structure or a lace combined only with the first lining, as well as to provide a first lace combined only with the first lining and a second lace combined only with the footwear structure.

In particular, the footwear item 1 comprises a first plurality of through holes denoted by 26 and arranged on the upper 4 of the footwear structure 2, particularly at the eyestay 7, and a second plurality of through holes denoted by 27 and arranged on the first lining 3, particularly at the side edges of the décolletage 21, the first and the second pluralities of through holes cooperating with the lace 25, wherein the distance of the notches 22 from the tip end 10 of the upper 4 is less than the distance of the second plurality of through holes 27 from the tip end 10 of the upper 4, although, as mentioned above, as an alternative to the first plurality of through holes 26 and/or the second plurality of through holes 27, respective pluralities of bodkins, bitts, hooks can be provided.

The through holes 26 of the first plurality of through holes, and the through holes 27 of the second plurality of through holes, which are engaged by the lace 25, are preferably arranged at positions corresponding to each other on the footwear structure 2 and on the first lining 3, respectively.

This solution is advantageous because it allows a more stable fixing of the first lining to the upper, since the lace passes through both the through holes arranged on the upper near the eyestay and the through holes arranged on the first lining, thereby limiting the relative movement of the first lining with respect to the upper.

Advantageously it should be further added that, according to the present invention and according to the examples of the figures, the lace 25 is combined with the first appendage 13 and in particular it can pass through a loop defined by the aforesaid ring-shaped body of the first appendage 13.

This solution is advantageous because the tension of the lace, being distributed through the first appendage in particular on the portion of the first lining at the tongue, helps them to be kept substantially adherent to each other by limiting the relative sliding between the first lining and the upper that could occur during the use of this footwear item, particularly during the walking of the user, as a result, for example, of the different stiffness of the materials that make up the upper and the first lining, the former being usually more rigid in order to resist wear and contact with external agents, the latter being usually softer in order to ensure greater comfort in the contact with the user's foot.

According to the invention and according to the examples of the figures, it should be added that the footwear item 1 comprises a second lining 28 arranged inside the footwear structure 2.

The second lining 28 is a fixed lining comprising a first layer or bottom layer combined with a plantar portion of footwear structure 2, for example the sole 5 or a midsole not shown in the examples of the figures, and a second layer or covering layer combined with the upper 4.

The second lining 28 practically covers at least part of the mating surface of the footwear structure with the first lining, and can consist of a layer of fabric or hides that allows the footwear structure 2 to be comfortably worn without necessarily inserting the first lining 3 therein.

Preferably and advantageously, the aforesaid first layer comprises a so-called three-dimensional fabric, i.e. a fabric of known type whose constituent fibers are arranged in a planar mutually perpendicular relationship. From the point of view of the manufacturing process, in a three-dimensional weaving, the sets of fibers X and Y are interwoven with the rows and columns of the axial fibers Z. Sets of fibers X and Y mean horizontal and vertical weft sets, respectively. Fibers Z means the multi-layer warp set. Three-dimensional fabrics can be obtained even with two-dimensional weaving processes. The three-dimensional fabric can also be obtained by knitting on straight or circular knitting machines. The aforesaid second layer comprises a so-called three-dimensional channelled fabric of known type, for example of the type described in EP 2007235 B1.

The three-dimensional fabric of the first layer, thanks to its structure, provides effective ventilation at the foot's plantar surface, while the three-dimensional channelled fabric of the second layer, having channels properly directed towards the mouth of the footwear structure, allows effective ventilation around the foot by promoting the rise of sweat in the vapor phase exactly towards the mouth of the footwear structure, and thus helping it to be expelled outside the footwear item according to the present invention.

The footwear item 1 may also comprise an insole of known type, not shown in the examples of the figures, removably combinable with the footwear structure 2, inside the latter.

According to the invention, the aforesaid insole is expected to have a volume substantially corresponding to the volume of the first lining 3.

An insole with a volume essentially corresponding to the volume of the first lining is particularly advantageous if the aforesaid footwear structure is used alone, without the first lining, as it compensates for the volume otherwise occupied by the same first lining, so that between the footwear structure and the user's foot there isn't too much space (clearance) which could cause relative movement between the foot and the footwear structure thereby causing the onset of blisters.

The advantages of the present invention, which became clear in the course of the above description, can be summarized by pointing out that a footwear item comprising a footwear structure and a lining removably housed inside the footwear structure (first lining) is provided, wherein the removable lining can be easily pulled by the user after wearing the footwear item by means of a special appendage (first appendage), so as to help the removable lining to adhere to the tongue and more generally to the region of the upper of the footwear structure corresponding to the upper front portion of the foot, thereby preventing the formation of creases and wrinkles in the removable lining.

To prevent the formation of creases and wrinkles, it is sufficient to make the aforesaid appendage coincident with a corresponding opening (first through opening) provided in the upper of the footwear structure without having to completely lay out the removable lining.

Therefore, the removable lining is made adherent to the upper of the footwear structure in a simple and effective way.

The user can further improve the adherence of the removable lining to the upper by pulling the aforesaid appendage and simultaneously pushing the foot into the footwear structure.

Still advantageously, the footwear item according to the present invention is made according to known processes in a simple and economical way.

In order to meet incidental and specific requirements, several variations and modifications could be made by a field technician to the illustrated and described embodiments of present invention, provided that all are included in the scope of protection of the invention as defined by the following claims.

The invention claimed is:

1. A footwear item comprising:

a footwear structure having an upper provided with a mouth, a tip end and a front portion that is between said mouth and said tip end, a first lining housed inside said footwear structure, and first combining means to removably combine said first lining with said upper, wherein said first combining means comprise at least one first through opening arranged on said front portion of said upper, and at least one first appendage externally arranged on said first lining at a position substantially corresponding to said at least one first through opening, wherein said at least one first appendage engages said at least one first through opening, said at least one first appendage being accessible from the outside of said footwear structure, wherein said front portion of said upper comprises a vamp and a tongue, wherein said at least one first through opening is arranged on said tongue at a position proximal to said vamp.

2. The footwear item according to claim 1, wherein said front portion of said upper comprises a vamp and a tongue, wherein said at least one first through opening is arranged on said tongue.

3. The footwear item according to claim 1, wherein said at least one first appendage comprises a ring-shaped body, wherein said ring-shaped body includes closing-opening elements to close-open said ring-shaped body, wherein said ring-shaped body is made of a flexible material.

4. The footwear item according to claim 1, comprising second combining means to removably combine said first lining with said upper, wherein said second combining means comprise at least one second appendage externally arranged on said first lining and having a first engaging member, wherein a second engaging member is externally arranged on the upper and is configured to cooperate with said first engaging member.

5. The footwear item according to claim 1, wherein said first lining comprises an upper portion designed to wrap around the dorsal and side surfaces of a user's foot, and a lower portion combined with said upper portion and designed to be in contact with the plantar surface of the user's foot, wherein said upper portion comprises a first portion proximal to said lower portion and a second portion distal from said lower portion, wherein said second portion has a cut-away region oriented towards said tip end.

6. The footwear item according to claim 1, wherein said first lining comprises an upper portion designed to wrap around the dorsal and side surfaces of a user's foot, and a lower portion combined with said upper portion and designed to be in contact with the plantar surface of the user's foot, wherein said upper portion is at least partially made of a first material and said lower portion is at least partially made of a second material, wherein said first material and said second material are different from each other.

7. The footwear item according to claim 6, wherein said first material is selected from hides; breathable material including breathable fabric; so-called three-dimensional fabric; fabric or hides having a polymeric material deposited thereon; and insulating material including padding or natural or synthetic films.

8. The footwear item according to claim 6, wherein said second material is selected from polymeric material including vulcanized rubber, thermoplastic rubber, thermoplastic polyurethane, ethylene-vinyl acetate; three-dimensional fabric; fabric or hides coated with resin or polymeric material; fabric or hides having a thermoplastic polymeric deposited thereon; nonwoven fabric including felt; leather; and breathable material including breathable fabric.

9. The footwear item according to claim 1, comprising closing-opening means to close-open said footwear structure and/or said first lining, wherein said closing-opening means to close-open said footwear structure and/or said first lining are selected from laces cooperating with holes, bodkins, bitts, hooks, straps cooperating with buckles, hook and loop fastening strips, and elastic bands.

10. The footwear item according to claim 9, wherein said upper comprises an eyestay and wherein said closing-opening means to close-open said footwear structure and/or said first lining comprise at least one lace, one first plurality of through holes arranged on said eyestay and engaged by said at least one lace, and one second plurality of through holes arranged on the aforesaid first lining and engaged by said at least one lace, wherein the through holes of said first plurality of through holes, and the through holes of said second plurality of through holes are arranged in positions corresponding to each other on said footwear structure and on said first lining, respectively, and wherein said at least one lace is combined with said at least one first appendage.

11. The footwear item according to claim 10, wherein said tongue is provided with a pair of notches arranged on opposite edges, a notch for each edge, thereby defining in said tongue an upper portion of tongue and a lower portion of tongue which are placed respectively above and below said notches, wherein at said upper portion of tongue, said first lining is interposed between said tongue and said eyestay, and wherein at said lower portion of tongue, said tongue is interposed between said first lining and said eyestay.

12. The footwear item according to claim 11, wherein the depth of said notches is between 5 mm and 35 mm.

13. The footwear item according to claim 1, wherein said footwear structure comprises a sole constrained to said upper, and a second lining combined with said upper and said sole with the interposition of a midsole.

14. The footwear item according to claim 13, wherein said second lining comprises a first layer combined with said sole or said midsole, and a second layer combined with said upper, wherein said first layer comprises a three-dimensional fabric and said second layer comprises a three-dimensional channelled fabric.

15. The footwear item according to claim 1, comprising an insole able to be removably combined with said footwear structure from the inside thereof, wherein the volume of said insole substantially corresponds to the volume of said first lining.

16. The footwear item according to claim 11, wherein the depth of said notches is between 10 mm and 30 mm.

* * * * *